US011065525B2

(12) United States Patent
Scala et al.

(10) Patent No.: US 11,065,525 B2
(45) Date of Patent: Jul. 20, 2021

(54) STOWABLE FUNCTIONAL TRAINING SYSTEM

(71) Applicant: Western Shelter Systems, Eugene, OR (US)

(72) Inventors: Michael Scala, Eugene, OR (US); Joseph Thomas, Veneta, OR (US); Timothy Riley, Springfield, OR (US); Ryan Scott Fox, Elmira, OR (US)

(73) Assignee: WESTERN SHELTER SYSTEMS, Eugene, OR (US)

( * ) Notice: Subject to any disclaimer, the term of this patent is extended or adjusted under 35 U.S.C. 154(b) by 41 days.

(21) Appl. No.: 16/717,856

(22) Filed: Dec. 17, 2019

(65) Prior Publication Data

US 2020/0222780 A1 Jul. 16, 2020

Related U.S. Application Data

(60) Provisional application No. 62/780,721, filed on Dec. 17, 2018.

(51) Int. Cl.
*B65D 88/12* (2006.01)
*A63B 21/00* (2006.01)
(Continued)

(52) U.S. Cl.
CPC ..... *A63B 71/0036* (2013.01); *A63B 1/00* (2013.01); *A63B 6/00* (2013.01); *A63B 21/0557* (2013.01);
(Continued)

(58) Field of Classification Search
CPC ..... A63B 71/0036; A63B 21/078; A63B 21/4029; A63B 21/0557; A63B 6/00;
(Continued)

(56) References Cited

U.S. PATENT DOCUMENTS 2,313,188 A * 3/1943 Woodburn ..... A63B 63/083 473/484
5,046,722 A * 9/1991 Antoon ..... A63B 21/169 482/39
(Continued)

FOREIGN PATENT DOCUMENTS

GB 2533977 A * 7/2016 ..... A63B 71/02

*Primary Examiner* — Nyca T Nguyen
(74) *Attorney, Agent, or Firm* — Saul Ewing Arnstein & Lehr LLP

(57) ABSTRACT

A Functional Training System (FTS) is provided and includes a system container, wherein the system container includes a container front, a container rear, a container first side, a container second side, a container bottom, and a container top, wherein the container front, container rear, container first side, container second side, container bottom, and container top define a container cavity. The FTS further includes an exercise structure, wherein the exercise structure includes a platform connector, wherein the platform connector is non-perpendicularly and securely associated with at least one of the container front, container rear, container first side, container second side, container bottom, and container top, and wherein when the exercise structure is securely associated with at least one of the container front, container rear, container first side, container second side, container bottom, and container top, the exercise structure is supported by the system container.

20 Claims, 12 Drawing Sheets

(51) Int. Cl.

| | |
|---|---|
| ***A63B 1/00*** | (2006.01) |
| ***A63B 71/00*** | (2006.01) |
| ***A63B 21/078*** | (2006.01) |
| ***A63B 21/055*** | (2006.01) |
| ***A63B 6/00*** | (2006.01) |
| ***A63B 21/072*** | (2006.01) |
| ***A63B 22/06*** | (2006.01) |
| ***A63B 22/04*** | (2006.01) |
| ***A63B 22/02*** | (2006.01) |

(52) U.S. Cl.
CPC ..... *A63B 21/072* (2013.01); *A63B 21/078* (2013.01); *A63B 21/4029* (2015.10); *A63B 21/4033* (2015.10); *A63B 22/02* (2013.01); *A63B 22/04* (2013.01); *A63B 22/0664* (2013.01); *B65D 88/121* (2013.01); *A63B 2225/105* (2013.01)

(58) Field of Classification Search
CPC ..... A63B 1/00; A63B 21/4033; A63B 21/072; A63B 22/0664; A63B 22/04; A63B 22/02; A63B 2225/105; A63B 22/0605; A63B 21/169; A63B 2210/50; B65D 88/121
See application file for complete search history.

(56) References Cited

U.S. PATENT DOCUMENTS 5,254,058 A * 10/1993 Savigny ..... A63B 69/0048 482/35
5,966,956 A * 10/1999 Morris ..... F25D 11/003 52/69
6,345,471 B1 * 2/2002 Gyllenhammar ..... E04B 1/3444 296/169
8,485,951 B1 * 7/2013 Adams ..... A63B 21/151 482/129
9,302,144 B1 * 4/2016 Benavides ..... A63B 21/00047
9,320,934 B1 * 4/2016 Pringle ..... A63B 21/068
10,240,339 B1 * 3/2019 Dominguez ..... E04H 1/1205
10,625,111 B2 * 4/2020 Beaver ..... A63B 1/00
2006/0258511 A1 * 11/2006 Postma ..... A63B 69/0048 482/35
2007/0032357 A1 * 2/2007 Piane, Jr. ..... A63B 71/0036 482/142
2008/0128463 A1 * 6/2008 Bryan ..... B60R 9/06 224/486
2010/0024316 A1 * 2/2010 Pope ..... E04B 1/3431 52/79.5
2011/0023925 A1 * 2/2011 Johnson ..... B60P 3/341 135/139
2012/0144762 A1 * 6/2012 Eatock ..... G09B 19/00 52/79.5
2013/0053220 A1 * 2/2013 Monaco ..... A63B 17/04 482/39
2014/0296037 A1 * 10/2014 Razzaq ..... A63B 22/0605 482/54
2015/0059257 A1 * 3/2015 Beaver ..... A63B 23/0458 52/27
2015/0290488 A1 * 10/2015 Hopperstad ..... A63B 23/0405 482/38
2016/0059104 A1 * 3/2016 Monaco ..... E04H 3/14 280/30
2016/0059105 A1 * 3/2016 Scade Garcia ..... E04H 1/12 52/69
2017/0136278 A1 * 5/2017 Gilchrist ..... A63B 9/00
2017/0209733 A1 * 7/2017 Beaver ..... A63B 17/00
2020/0171369 A1 * 6/2020 Sudeith ..... A63B 69/0048
2020/0230458 A1 * 7/2020 Dery ..... A63B 21/00047

* cited by examiner

*Section B*

*Section C*

STOWABLE FUNCTIONAL TRAINING SYSTEM

RELATED APPLICATIONS

This application claims priority to and benefit of the filing date of U.S. Provisional Patent Application Ser. No. 62/780,721, filed Dec. 17, 2018, the contents of which are incorporated by reference herein in its entirety.

FIELD OF THE INVENTION

The present invention relates generally to a functional training system and more particularly to a functional training system that is capable of being easily stored in a container and easily deployed as desired.

BACKGROUND OF THE INVENTION

A functional training system is an exercise system that allows a user to perform one or more exercises which employ traditional bodyweight exercises, such as pull-ups, rope climbing, etc. These systems may also include accessories that support other traditional exercise platforms, such as a weight bench/support, dip bars, bungee hooks, jumping platforms, etc. Unfortunately, however, this type of system is typically fixed in place and once assembled it tends to be a permanent structure that occupies a dedicated space. This is undesirable for situations where the system is moved frequently or where there is limited dedicated space available for exercising. These situations may include temporary military bases and/or temporary work compounds. Referring to FIG. 1, one way that has been addressed is that the functional training system is configured to be stowable within a platform container and easily deployable for use. Thus, for situations where a dedicated exercise space is either limited or unavailable, this stowable platform allows the exercise equipment to be stored when not in use. Additionally, the container in which the platform is stowed may be movable. This is advantageous because it allows the system to be easily stowed within the platform container, moved and deployed when being used. This is useful for areas that cannot have a dedicated exercise area or for situations where the exercise location is relocated multiple times, such as with military situations.

Unfortunately, however, current designs require that the functional training system platform be supported via a ground support. This is undesirable because these functional training systems cannot be used in areas where the ground is either not level or is not stable without building an extraneous support platform to support the training system. For example, temporary military bases or work compounds that are located one unstable sandy ground or that are located in rocky terrain cannot support such a platform without having dedicated and level support areas located external to the platform container. Accordingly, this also undesirably increases the required dedicated space for the functional training system to an area much larger than the platform container itself.

SUMMARY OF THE INVENTION

A Functional Training System (FTS) is provided and includes a system container, wherein the system container includes a container front, a container rear, a container first side, a container second side, a container bottom, and a container top, wherein the container front, container rear, container first side, container second side, container bottom, and container top define a container cavity. The FTS further includes an exercise structure, wherein the exercise structure includes a platform connector, wherein the platform connector is non-perpendicularly and securely associated with at least one of the container front, container rear, container first side, container second side, container bottom, and container top, and wherein when the exercise structure is securely associated with at least one of the container front, container rear, container first side, container second side, container bottom, and container top, the exercise structure is supported by the system container.

A Functional Training System (FTS) is provided and includes a system container, wherein the system container includes a plurality of container walls that define a container cavity, and an exercise structure, wherein the exercise structure includes a platform connector, wherein the platform connector is securely associated with at least one of the plurality of container walls such that the platform connector is non-perpendicular with the at least one of the plurality of container walls, and wherein when the exercise structure is securely associated with the at least one of the plurality of container walls, the exercise structure is supported by the system container.

A Stowable Functional Support Platform is provided and includes a system container, wherein the system container includes a container front, a container rear, a container first side, a container second side, a container bottom, and a container top, wherein the container front, container rear, container first side, container second side, container bottom, and container top define a container cavity, and a functional support platform, wherein the functional support platform includes a platform connector, wherein the platform connector is non-perpendicularly and securely associated with at least one of the container front, container rear, container first side, container second side, container bottom, and container top, and wherein when the functional support platform is securely associated with at least one of the container front, container rear, container first side, container second side, container bottom, and container top, the functional support platform is supported by the system container.

BRIEF DESCRIPTION OF THE DRAWINGS

The foregoing and other features and advantages of the present invention will be more fully understood from the following detailed description of illustrative embodiments, taken in conjunction with the accompanying drawings in which like elements are numbered alike in the several Figures.

DETAILED DESCRIPTION OF THE INVENTION

Figure 1:
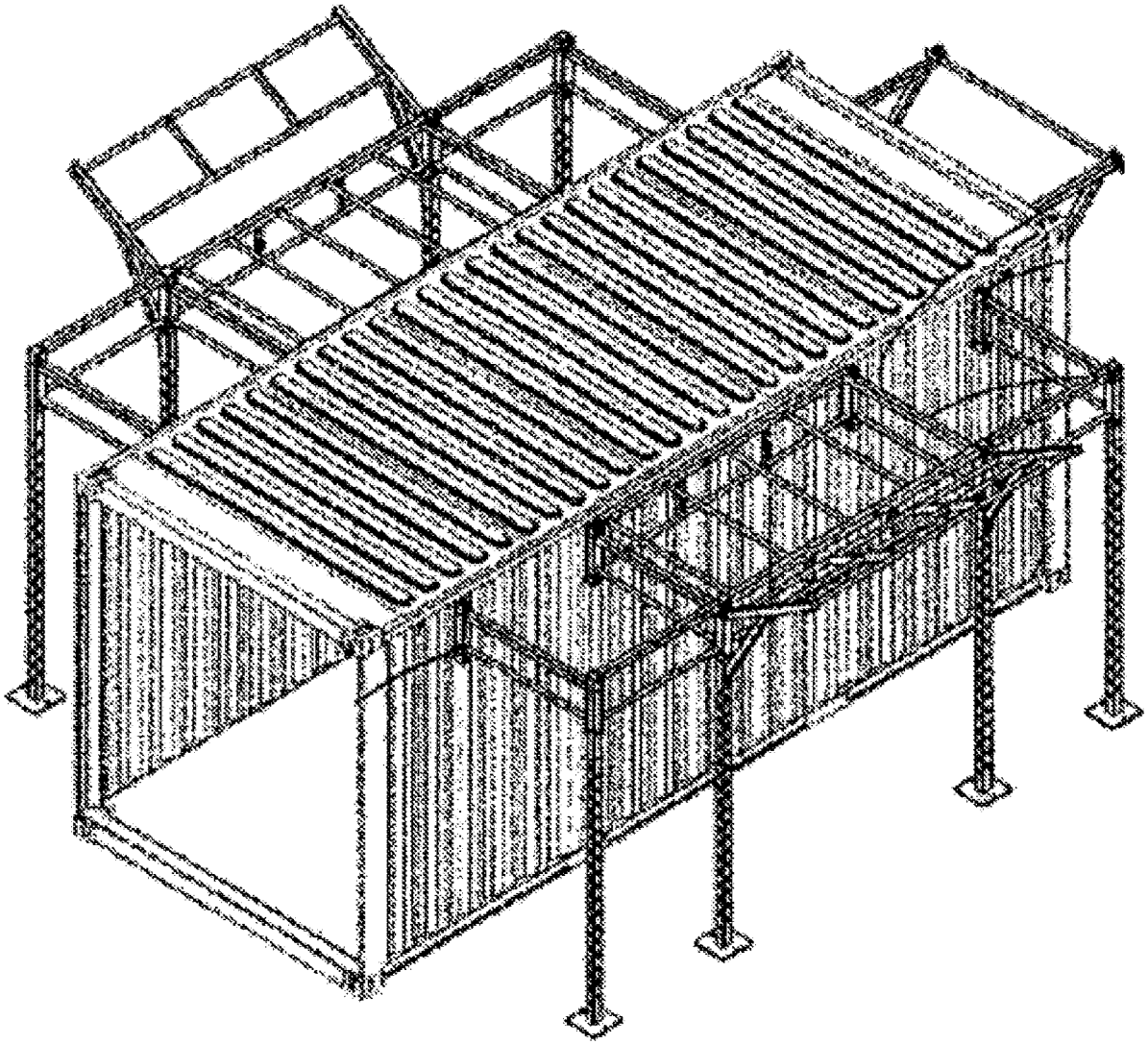
FIG. 1 PRIOR ART
FIG. 1 is a side, top down perspective view of a Functional Training System (FTS), in accordance with the prior art.
Figure 2:
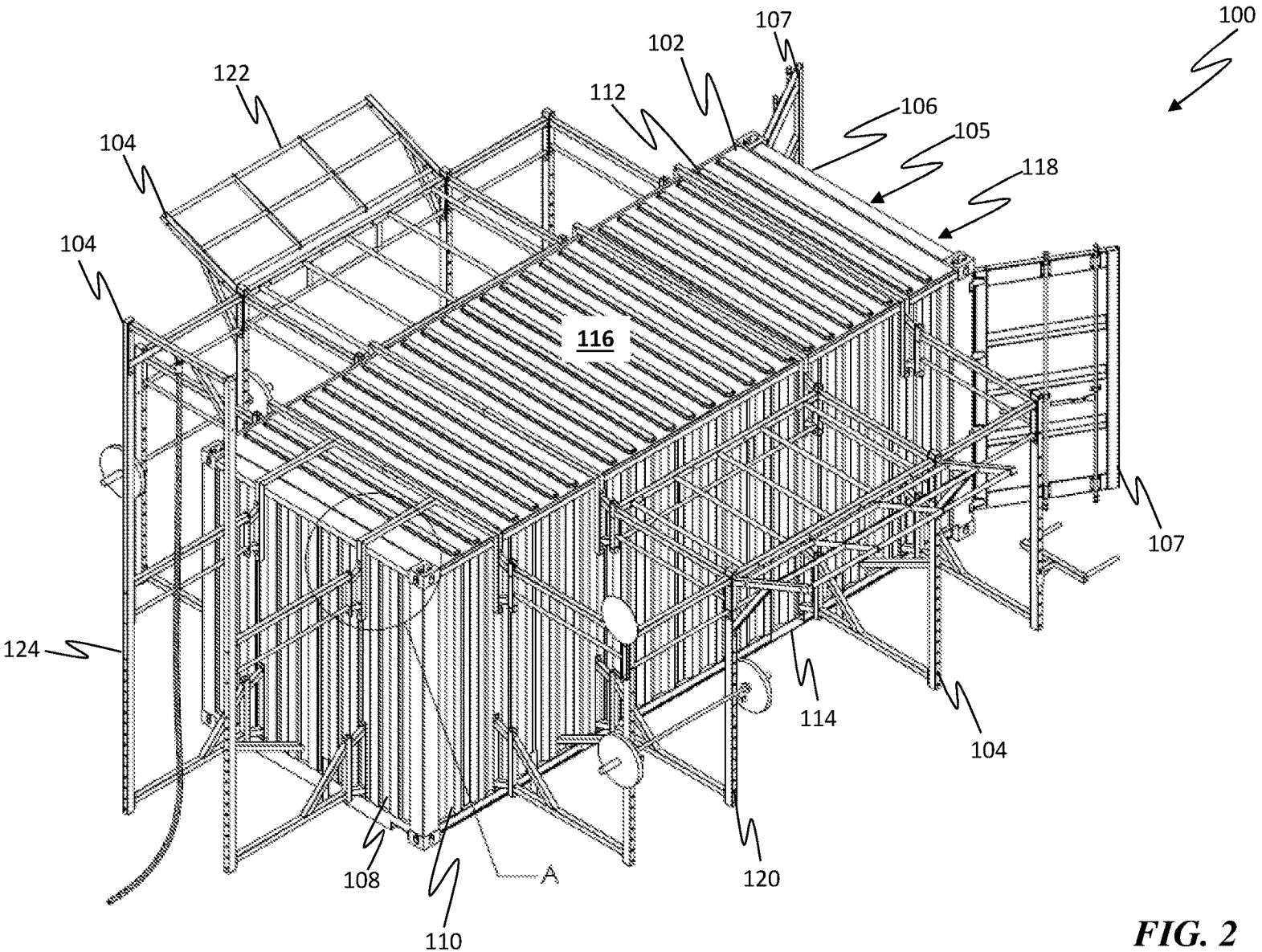
FIG. 2 is a top down, side perspective view of a Functional Training System (FTS), in accordance with one embodiment of the invention.

Referring to FIGS. 2-5, it should be appreciated that one embodiment of a Functional Training System (FTS) 100 having a platform or system container 102 and one or more exercise structures 104 which are stowable within the system container 102 is provided. Referring to FIG. 2, the system container 102 includes a container front 106, a container rear 108, a container first side 110, a container second side 112, a container bottom 114 and a container top 116, wherein the container front 106, container rear 108, and container first and second sides 110, 112, container bottom 114 and container top 116 define a container cavity 118 for stowing and containing the one or more exercise structures 104. It should be appreciated that the container front 106 defines an opening 105 which is communicated with and allows access to the container cavity 118. Moreover, the system container 102 includes at least one door 107 which is configurable between an open configuration and a closed configuration, wherein when in the closed configuration, the at least one door 107 is located proximate the opening 105 to cover the opening 105 to limit or prevent access to the container cavity 118 and when in the open configuration, the at least one door 107 is located away from the opening 105 to allow access to the container cavity 118. The one or more exercise structures 104 are configured to allow a user to perform one or more exercises, wherein the one or more exercise structures 104 are configured to be supportingly mounted to the system container 102. It should be appreciated that the one or more exercise structures 104 are advantageously self-supported and/or supported by the system container 102.

Figure 3:
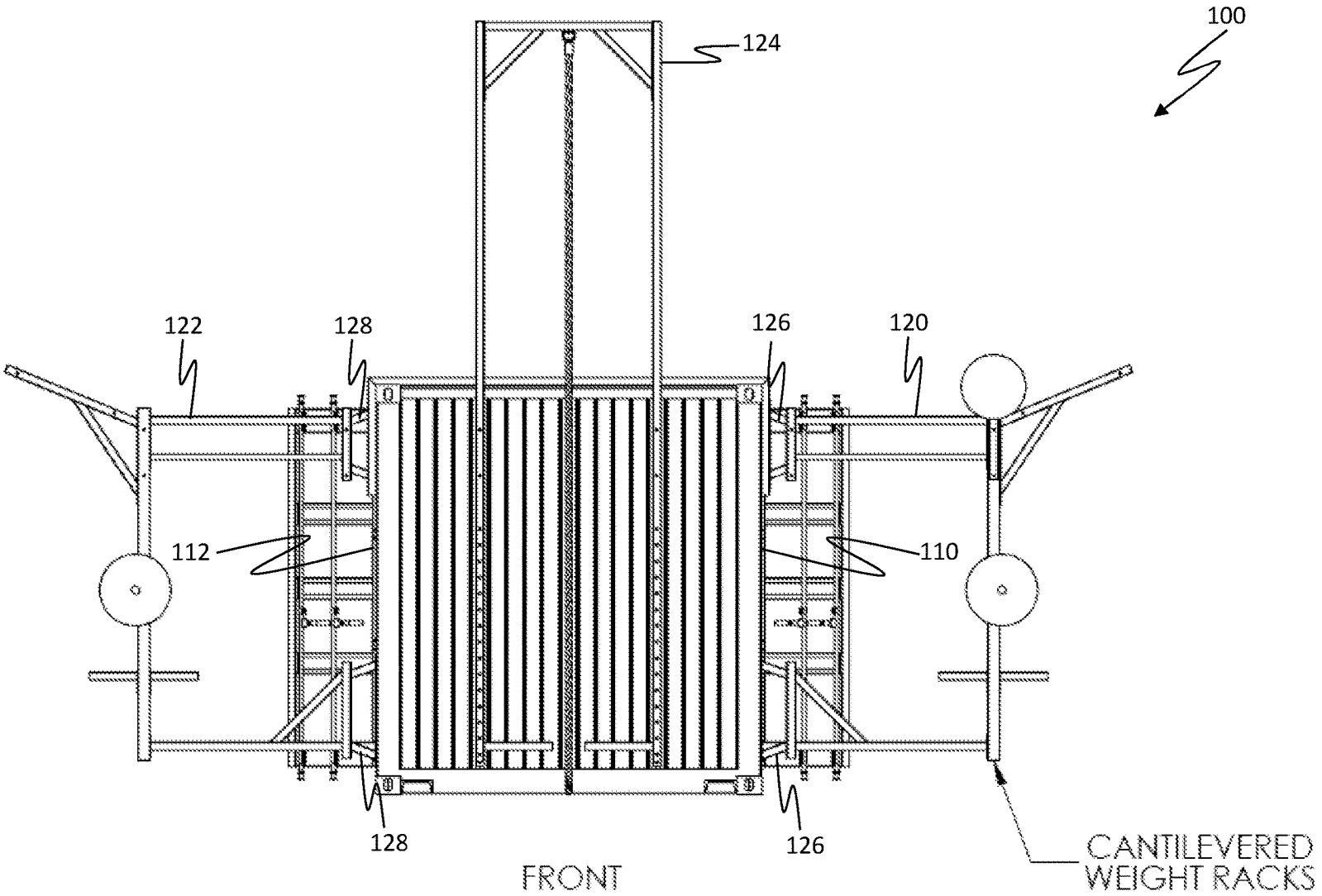
FIG. 3 is a front view of the FTS of FIG. 2.
Figure 4:
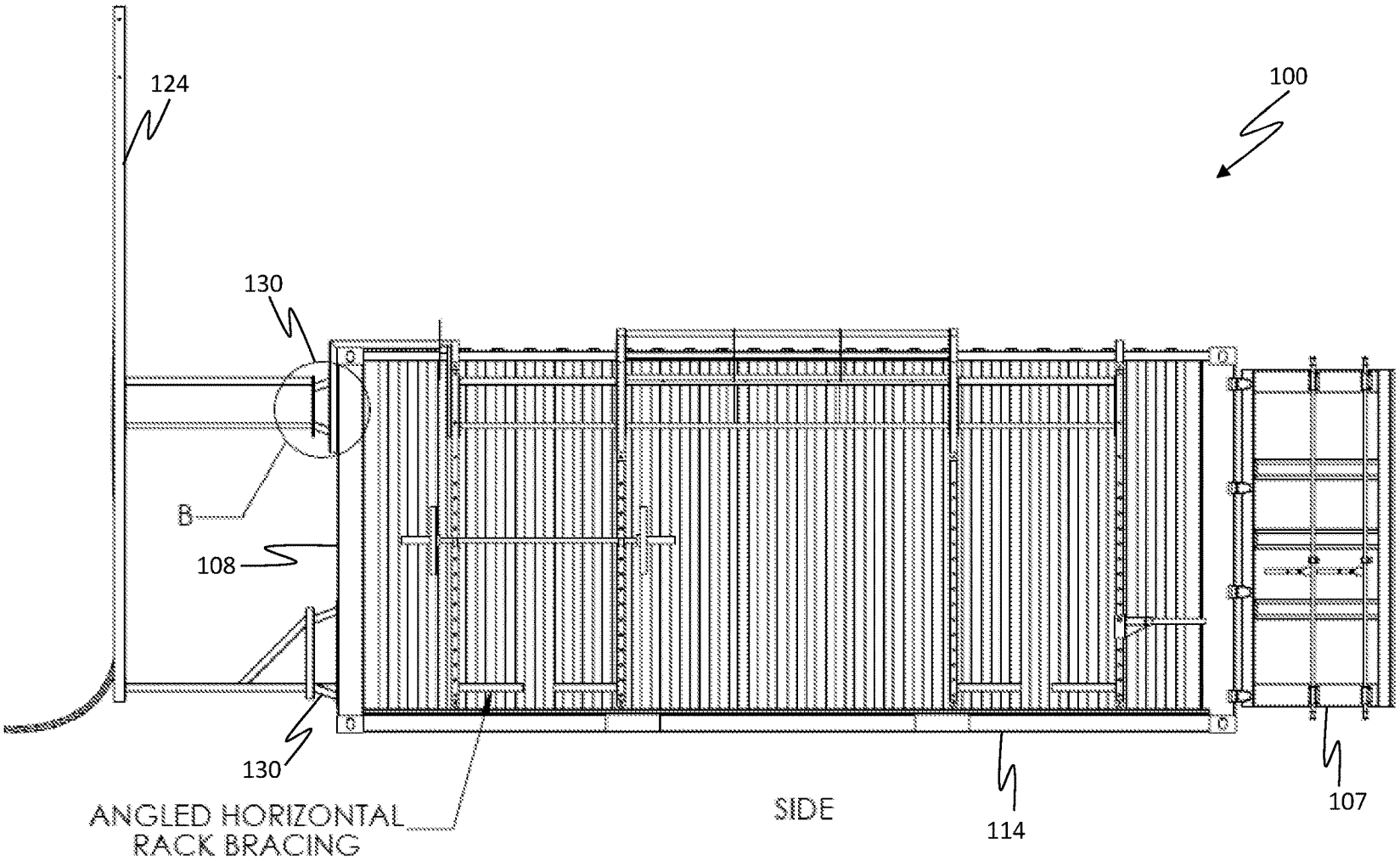
FIG. 4 is a side view of the FTS of FIG. 2.

It should be appreciated that the one or more exercise structures 104 include a first exercise platform 120, a second exercise platform 122 and a third exercise platform 124, wherein the first exercise platform 118 is located proximate the container first side 110, the second exercise platform 122 is located proximate container second side 112 and the third exercise platform 124 is located proximate container rear 108. Referring to FIG. 3, the first exercise platform 120 may be connected to the container first side 110 via one or more of first side platform connector structures 126, wherein the first side platform connector structures 126 are configured to be non-perpendicular (i.e. non-horizontal) relative to the container first side 110. Moreover, the second exercise platform 122 may be connected to the container second side 112 via one or more second side platform connector structures 128, wherein the second side platform connector structures 128 are configured to be non-perpendicular (i.e. non-horizontal) relative to the container second side 110. Similarly, referring to FIG. 4, the third exercise platform 124 may be connected to the container rear 108 via one or more third side platform connector structures 130, wherein the third side platform connector structures 130 are configured to be non-perpendicular (i.e. non-horizontal) relative to the container rear 108.

Figure 5A:
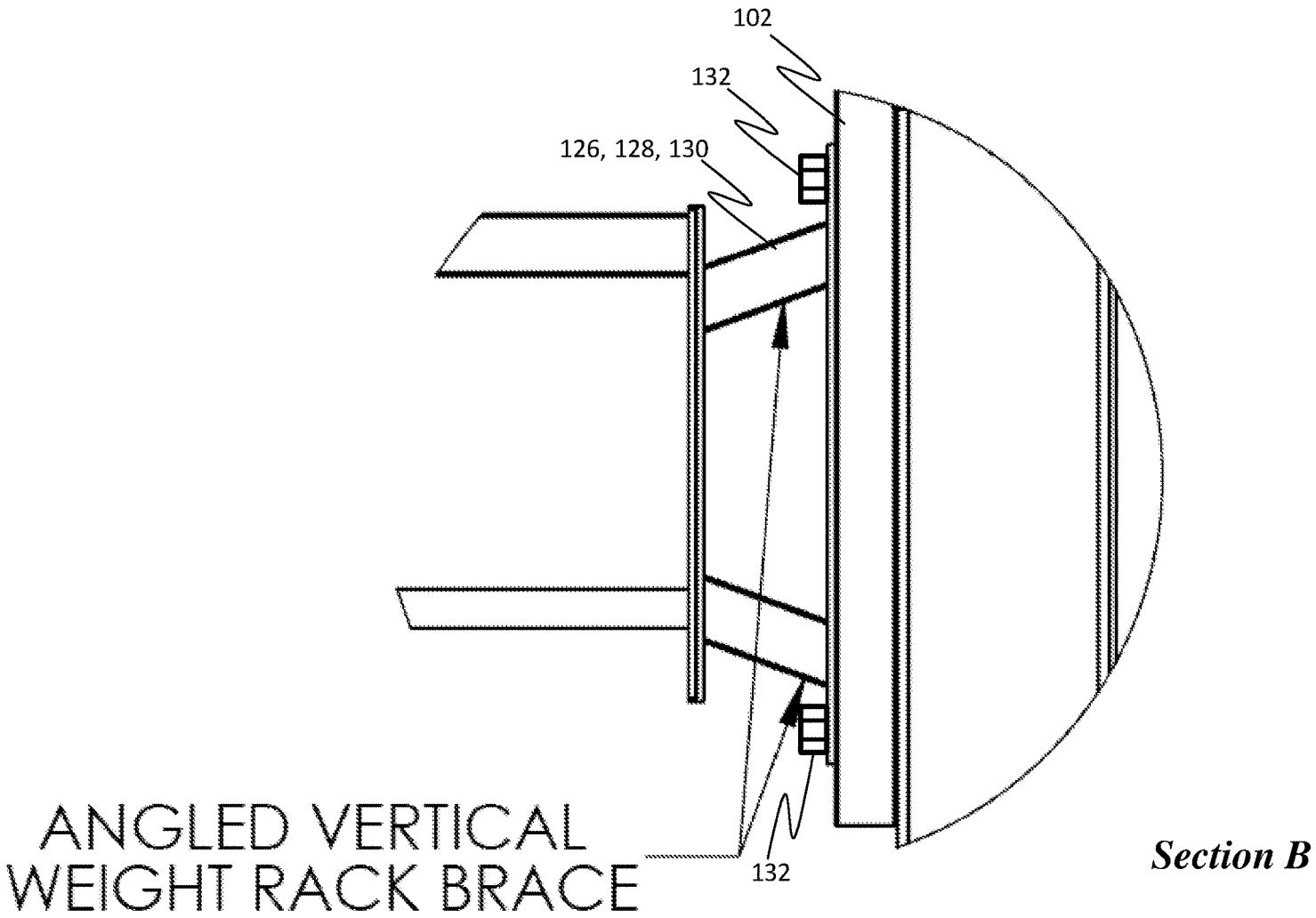
FIG. 5A is a side view of a platform connector structure connected to the system container of the FTS of FIG. 1, in accordance with one embodiment of the invention.
Figure 5B:
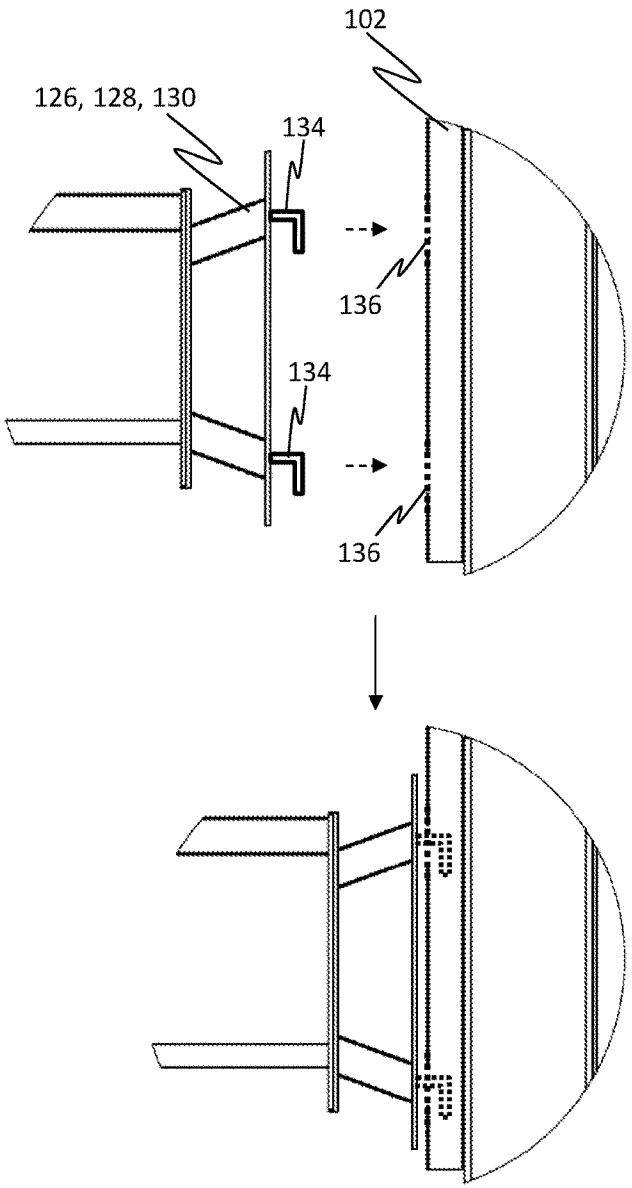
FIG. 5B is a side view of a platform connector structure connected to the system container of the FTS of FIG. 1, in accordance with another embodiment of the invention
Figure 6:
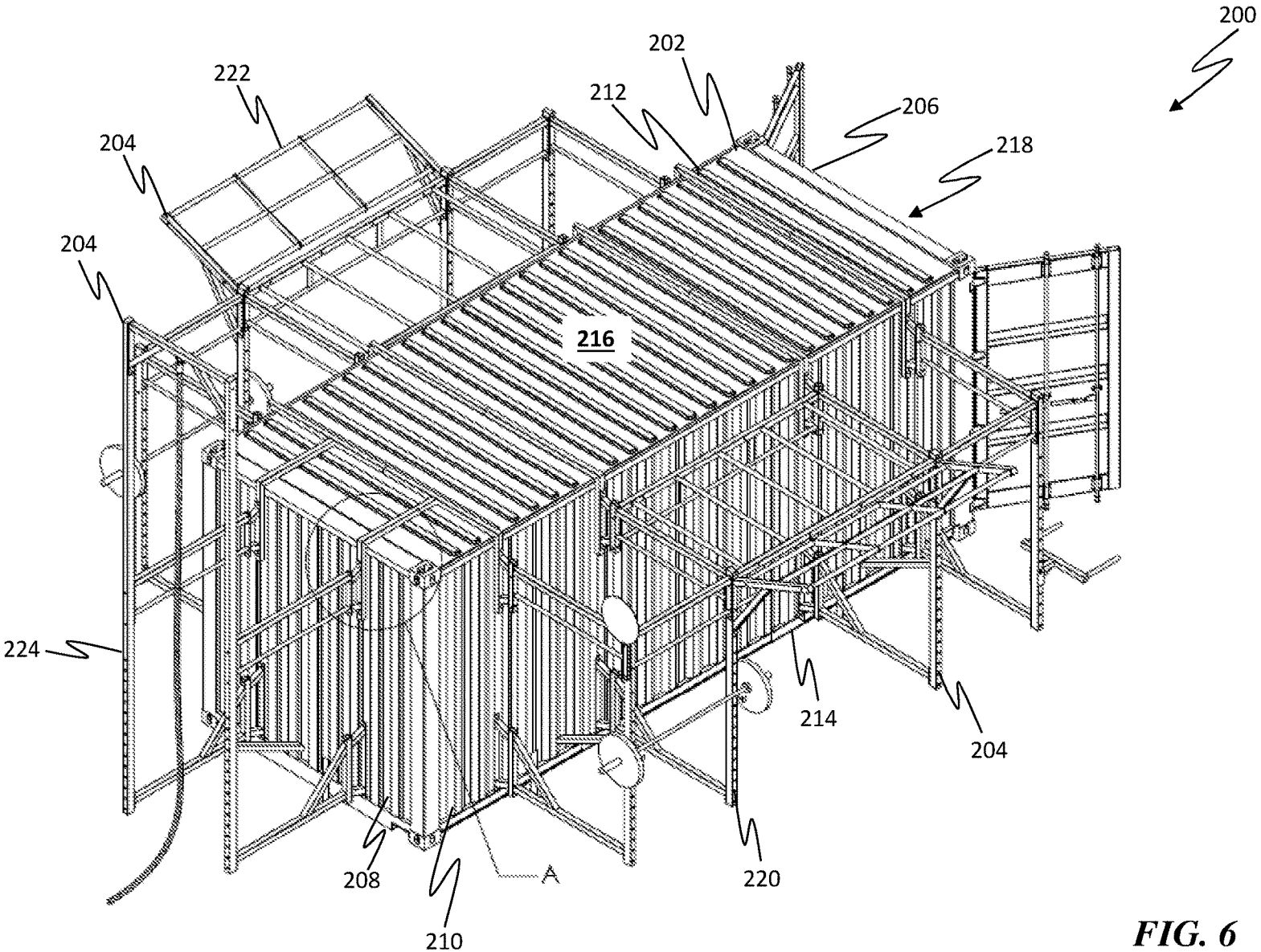
FIG. 6 is a top down, side perspective view of a Functional Training System (FTS), in accordance with another embodiment of the invention.
Figure 7:
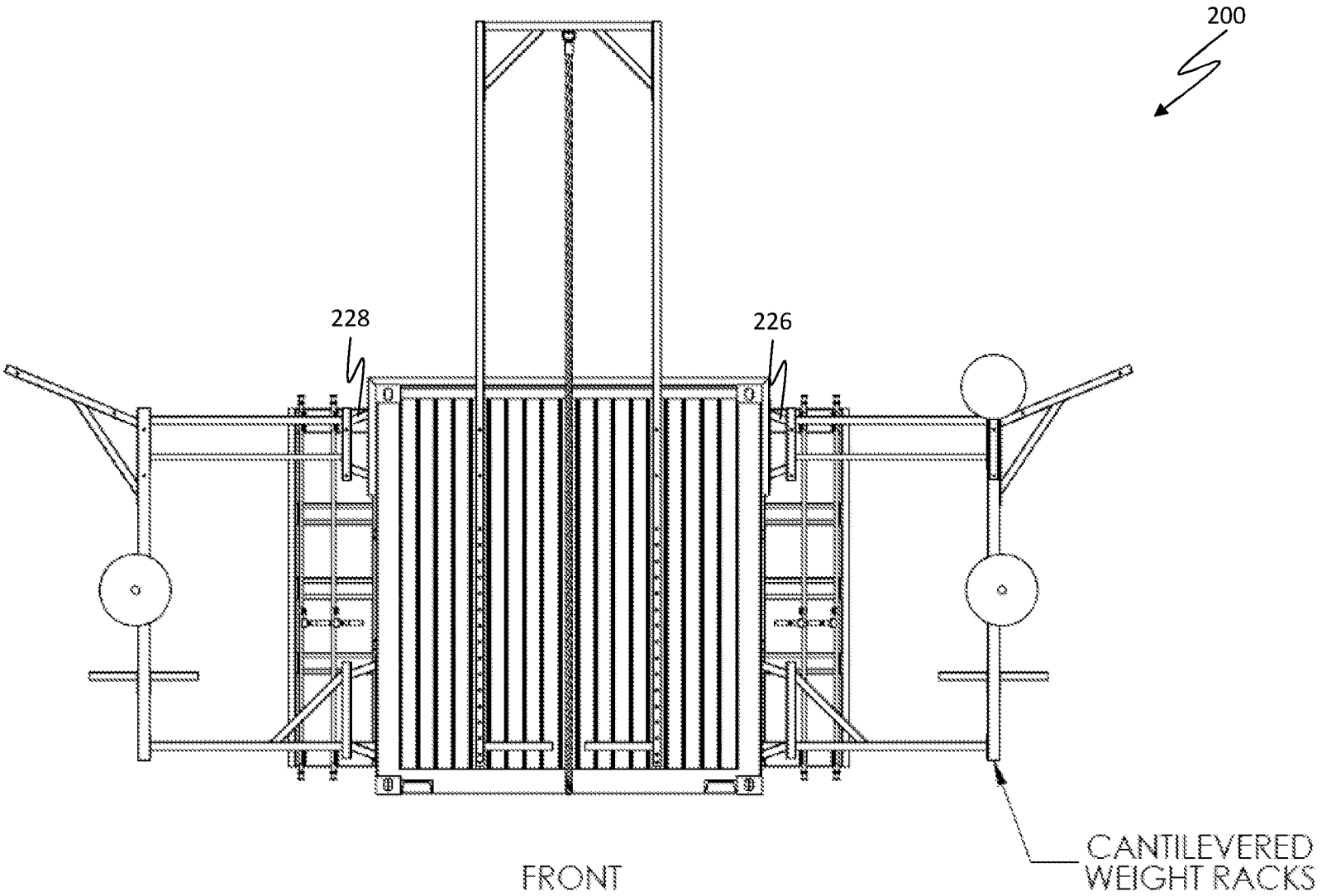
FIG. 7 is a front view of the FTS of FIG. 6.
Figure 8:
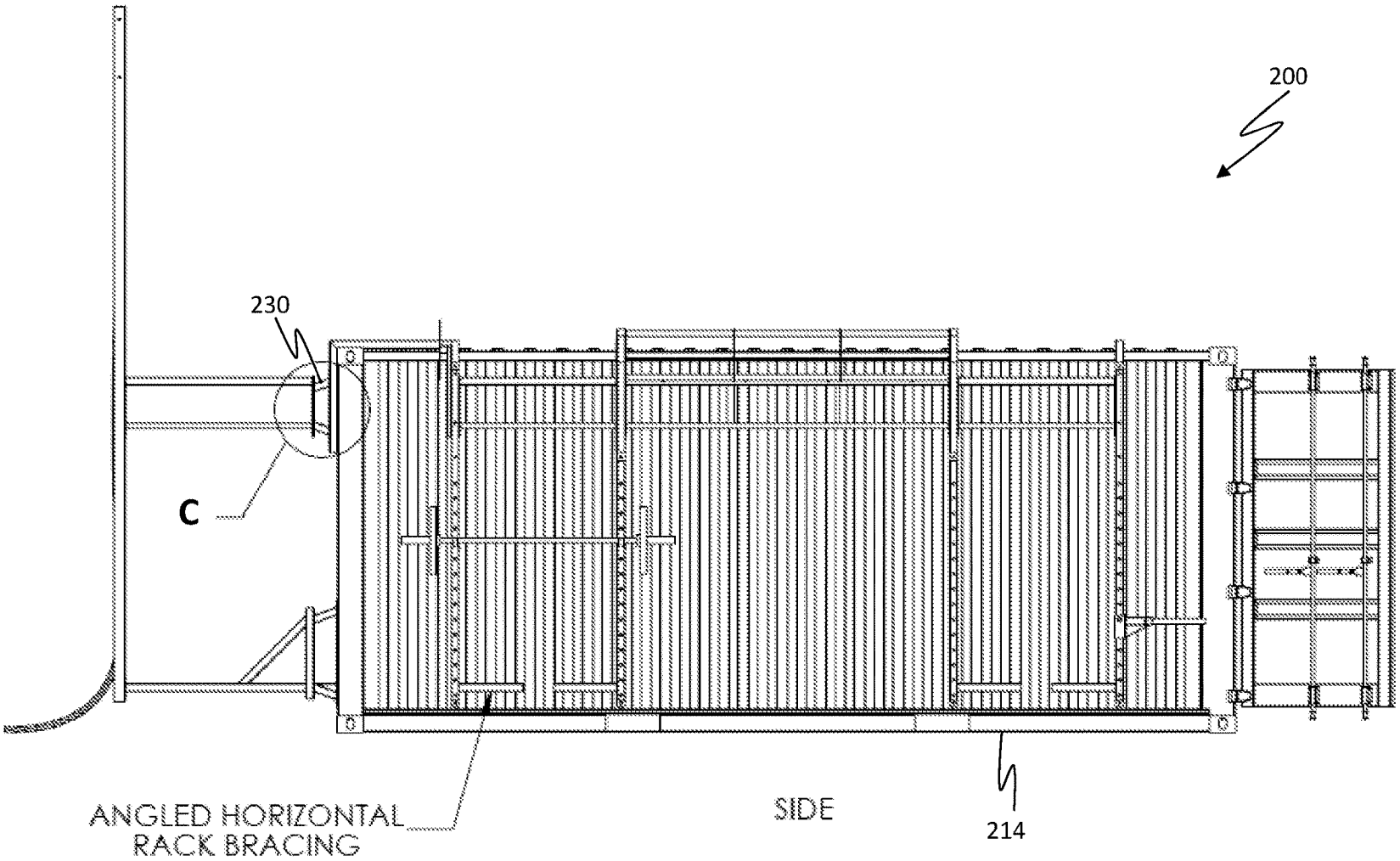
FIG. 8 is a side view of the FTS of FIG. 6.
Figure 9:
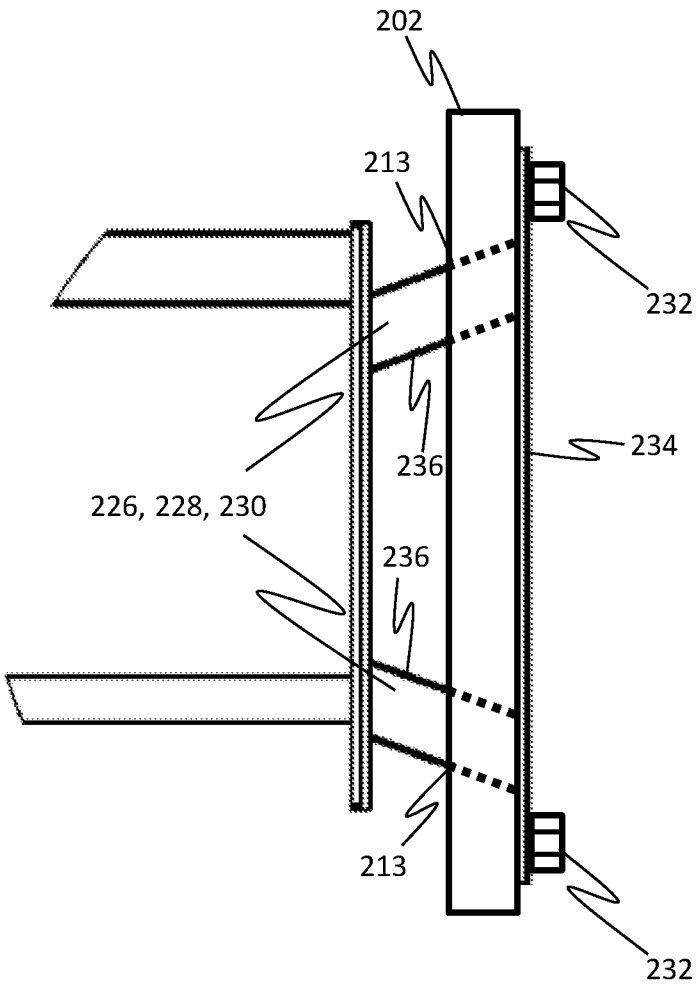
FIG. 9 is side sectional view of a platform connector structure connected to the system container of the FTS of FIG. 6, in accordance with another embodiment of the invention.

Accordingly, referring to FIG. 5A, all mounting connections between the first exercise platform 120, the second exercise platform 122 and third exercise platform 124 and the system container 102 are non-horizontal (i.e. non-perpendicular). One of the unique and novel features of the present invention is that the angled configuration (i.e. non-horizontal) of the first side platform connector structures 126, second side platform connector structures 128 and third side platform connector structures 130 provide for a more compact and stronger support for the first exercise platform 120, second exercise platform 122 and third exercise platform 124. It should be appreciated that the first side platform connector structures 126, second side platform connector structures 128 and/or third side platform connector structures 130 may be securely connected to the outside of the system container 102 via any securing method and/or device suitable to the desired end purpose, such as welds, bolts and/or screws 132. Moreover, referring to FIG. 5B, in another embodiment it is contemplated that the first side platform connector structures 126, second side platform connector structures 128 and/or third side platform connector structures 130 may be securely associated with the container first side 110, container second side 112 and/or container rear 108 via an angled tab 134 and slot 136 configuration. In this embodiment, the system container 102 may include slots 136 located in the sides (or in plates connected to the sides) of the system container 102 which are configured to receive and contain the angled tabs 134. To securely associate the first side platform connector structures 126, second side platform connector structures 128 and/or third side platform connector structures 130 with the system container 102, the angled tabs 134 are located within the slots 136 such that the first side platform connector structures 126, second side platform connector structures 128 and/or third side platform connector structures 130 may be associated with the system container 102 in a cantilevered fashion.

Another unique and novel feature of the present invention is that the first exercise platform 120, the second exercise platform 122 and third exercise platform 124 are securely connected to the system container 102 so that the first exercise platform 120, second exercise platform 122 and third exercise platform 124 are completely supported by the system container 102 and are not supported by the ground. In fact, the first exercise platform 120, second exercise platform 122 and third exercise platform 124 may not even be in contact with the ground. This saves on time and effort in locating, securing and/or configuring the ground surrounding the FTS 100 to be relatively flat and/or stable. Referring again to FIG. 5A, it is contemplated that the first exercise platform 120, the second exercise platform 122 and/or third exercise platform 124 are securely connected to the exterior of the system container 102.

Referring to FIGS. 6-9, it should be appreciated that another embodiment of a Functional Training System (FTS) 200 having a system container 202 and one or more exercise structures 204 which are stowable within the system container 202 is provided. The system container 202 includes a container front 206, a container rear 208, a container first side 210, a container second side 212, a container bottom 214 and a container top 216, wherein the container front 206, container rear 208, and container first and second sides 210, 212, container bottom 214 and container top 216 define a container cavity 218 for stowing and containing the one or more exercise structures 204. It should be appreciated that the system container 202 includes a plurality of openings 213 in at least one of the container rear 208, container first side 210 and/or the container second side 212. The one or more exercise structures 204 are configured to allow a user to perform one or more exercises, wherein the one or more exercise structures 204 may be configured to be mounted to the inside wall surface of the system container 202 via the plurality of openings 213 as discussed hereinafter. It should be appreciated that the one or more exercise structures 204 are self supported and/or supported by the system container 202.

The one or more exercise structures 204 may include a first exercise platform 220, a second exercise platform 222 and a third exercise platform 224, wherein the first exercise platform 218 is located proximate the container first side 210, the second exercise platform 222 is located proximate container second side 212 and the third exercise platform 224 is located proximate container rear 208. The first exercise platform 220 may be connected to the container first side 210 via a plurality of first side platform connector structures 226, wherein the first side platform connector structures 226 are configured to be non-perpendicular (i.e. non-horizontal) relative to the container first side 210. Moreover, the second exercise platform 222 may be connected to the container second side 212 via a plurality of second side platform connector structures 228, wherein the second side platform connector structures 228 are configured to be non-perpendicular (i.e. non-horizontal) relative to the container second side 210. Similarly, the third exercise platform 224 may be connected to the container rear 208 via a plurality of third side platform connector structures 230, wherein the third side platform connector structures 230 are configured to be non-perpendicular (i.e. non-horizontal) relative to the container rear 208.

It should be appreciated that in this embodiment, the first side platform connector structures 226, second side platform connector structures 228 and/or third side platform connector structures 230 may include a mounting brace plate 234 and one or more brace bar(s) 236 extending therefrom. The mounting brace plates 234 are located proximate to and securely attached to the internal surface of the container rear 206, container first side 208 and/or container second side 210, wherein the brace bars 236 extend out of and away from the plurality of openings 213 in a non-horizontal fashion. The first exercise platform 220, second exercise platform 222 and third exercise platform 224 may be securely connected to the brace bars 236 thereby connecting the first exercise platform 220, second exercise platform 222 and third exercise platform 224 to the internal surface of the system container 202. It should be appreciate that the brace bars 236 may be securely connected with the first exercise platform 220, second exercise platform 222 and third exercise platform 224 via any securing method and/or device suitable to the desired end purpose, such as welds, bolts and/or screws 232.

Figure 10:
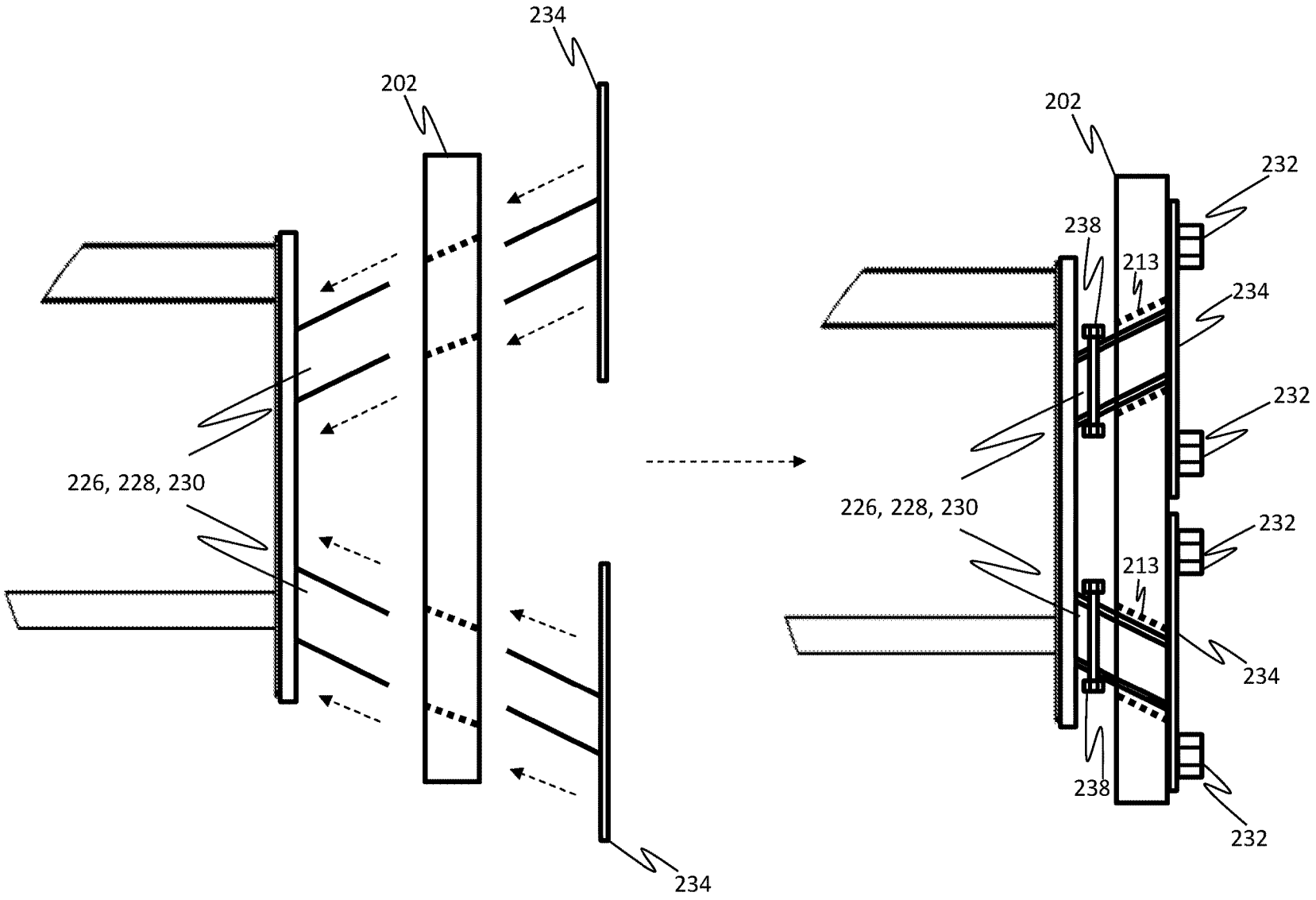
FIG. 10 is side sectional view of a platform connector structure connected to the system container of the FTS of FIG. 6, in accordance with still yet another embodiment of the invention.

Referring to FIG. 10 shows one embodiment of a first side platform connector structure 226, second side platform connector structure 228 and/or third side platform connector structure 230 where the first side platform connector structure 226, second side platform connector structure 228 and/or third side platform connector structure 230 are connected to the internal surface of the system container 202. In this embodiment, the mounting brace plates 234 are securely connected to the internal surface of the system container 202 via bolts 232. Additionally, the mounting brace plates 234 are connected securely associated with the first side platform connector structures 226, second side platform connector structures 228 and/or third side platform connector structures 230 via a second securing device 238, wherein the second securing device 238 may be any securing method and/or device suitable to the desired end purpose, such as welds, pins, bolts and/or screws 238.

Figure 11:
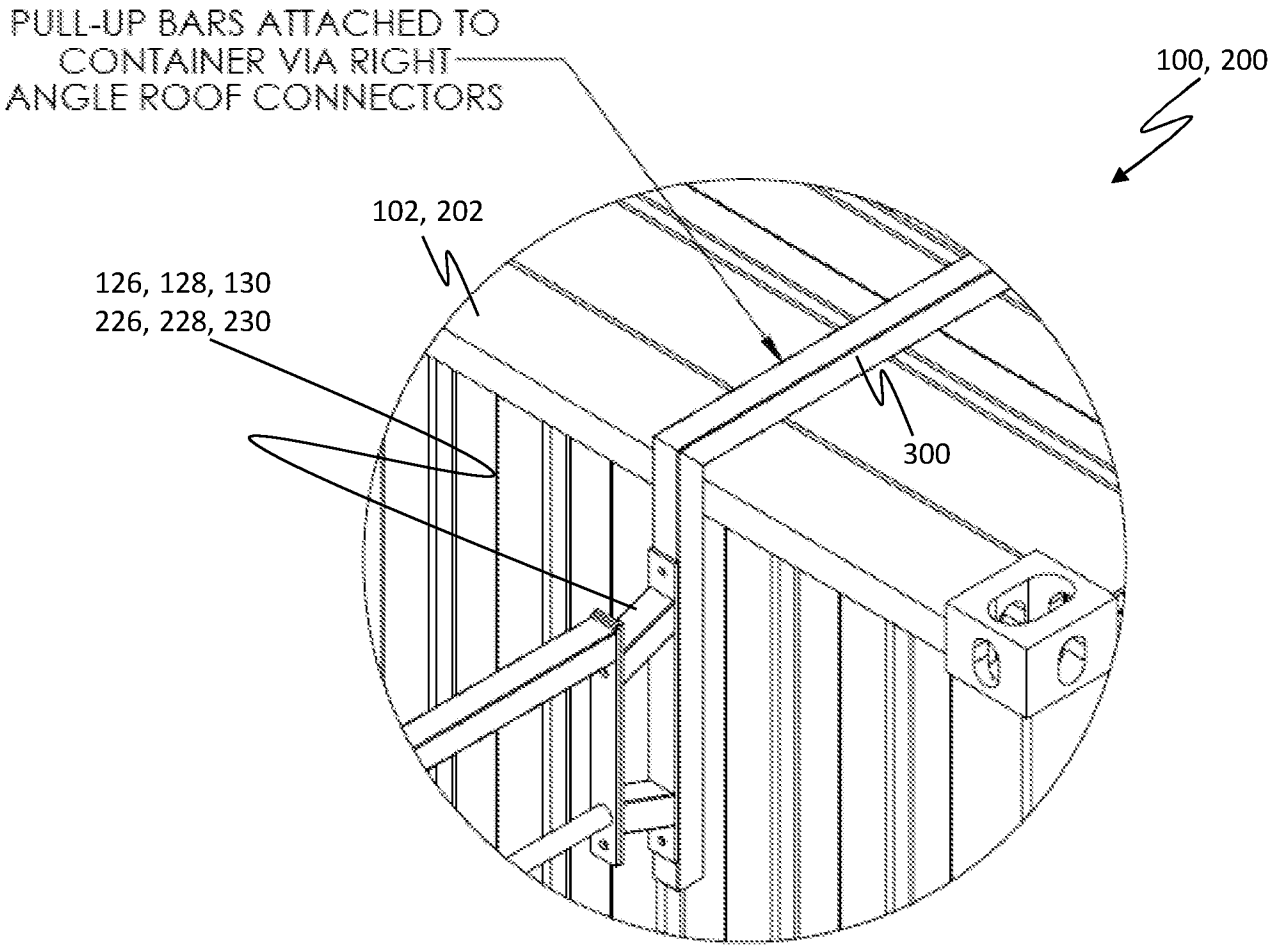
FIG. 11 is top down, side view of a platform connector structure connecting one or more of the exercise structures to the system container of the FTS of FIG. 1 and/or FIG. 2.

Referring to FIG. 11, it should be further appreciated that the first exercise platform 118, 218, second exercise platform 122, 222 and/or third exercise platform 124, 224 may be further supported via a roof support 300 which may be securely associated with the container top 116, 216. The roof support 300 may be securely associated with the container top 116, 216 via any device and/or method suitable to the desired end purpose, such as bolts, screws, welding, etc. Additionally, in one embodiment the roof support 300 may be U-shaped to sit over the container top 116, 216 and extend downward proximate the container first side 110, 210, container second side 112, 212 and/or container rear 106, 206.

It should be appreciated that the first exercise platform 118, 218, second exercise platform 122, 222 and/or third exercise platform 124, 224 may include various exercise platforms such as those that allows a user to perform one or more exercises which employ traditional bodyweight exercises, such as pull-ups, dips, rope climbing, etc. These systems may also include accessories that support other traditional exercise platforms, such as a weight bench/supports, universal weight systems, dip bars, bungee hooks, jumping platforms, ropes, treadmills, ellipticals, stair climbers, etc.

It should be appreciated that the invention as disclosed herein is described in terms of an exercise structure that is completely supported by the system container 102, 202. It is contemplated that the invention is not limited to the purposes disclosed herein and may be applied to various other articles as well. For example, the exercise structure may be substituted for a support platform for electronics, foods, medical purposes (such as patient support), and other purposes.

While the invention has been described with reference to an exemplary embodiment, it should be understood by those skilled in the art that various changes may be made and equivalents may be substituted for elements thereof without departing from the scope of the invention. Moreover, the embodiments or parts of the embodiments may be combined in whole or in part without departing from the scope of the invention. In addition, many modifications may be made to adapt a particular situation or material to the teachings of the invention without departing from the scope thereof. Therefore, it is intended that the invention not be limited to the particular embodiment disclosed as the best mode contemplated for carrying out this invention, but that the invention will include all embodiments falling within the scope of the appended claims. Moreover, unless specifically stated any use of the terms first, second, etc. do not denote any order or importance, but rather the terms first, second, etc. are used to distinguish one element from another.

We claim:

1. A Functional Training System (FTS), comprising:

a system container, wherein the system container includes a container front, a container rear, a container first side, a container second side, a container bottom, and a container top, wherein the container front, container rear, container first side, container second side, container bottom, and container top define a container cavity, and an exercise structure, wherein the exercise structure includes at least one platform connector comprising a first brace plate parallel to a second brace plate, and at least two brace bars, each brace bar coupling the first brace plate and the second brace plate together, and a length of each brace bar is non-perpendicular with respect to the first brace plate and the second brace plate, wherein the at least two brace bars are non-perpendicularly and securely associated with at least one of the container front, container rear, container first side, container second side, container bottom, or container top, and wherein when the exercise structure is securely associated with at least one of the container front, container rear, container first side, container second side, container bottom, or container top, the exercise structure is wholly supported by the system container.

2. The FTS of claim 1, wherein when the exercise structure is connected to the system container, the exercise structure is positioned away from the ground surface.

3. The FTS of claim 1, wherein the exercise structure includes at least one of a pull-up bar, a dip bar, a climbing rope, a weight bench/support, a universal weight system, a bungee hook, a jumping platform, a treadmill, an elliptical or a stair climber.

4. The FTS of claim 1, wherein when the exercise structure is connected to the system container, the at least one platform connector is non-horizontal relative to system container.

5. The FTS of claim 1, wherein when the exercise structure is connected to the system container, the exercise structure is connected to an external surface of at least one of the container front, container rear, container first side, container second side, container bottom, or container top.

6. The FTS of claim 1, wherein when the exercise structure is connected to the system container, the exercise structure is connected to an internal surface of at least one of the container front, container rear, container first side, container second side, container bottom, or container top.

7. The FTS of claim 1, wherein the exercise structure is stowable within the container cavity.

8. The FTS of claim 1, wherein the system container includes at least one door, wherein the at least one door is configurable between an open configuration and a closed configuration, wherein when the at least one door is in the closed configuration, the at least one door is configured to cover enclose the container cavity.

9. The FTS of claim 1, wherein the at least one platform connector is non-perpendicularly and securely associated with at least one of the container front, container rear, container first side, container second side, container bottom, or container top via at least one of a bolt, a screw or a tab/slot combination.

10. A Functional Training System (FTS), comprising: a system container, wherein the system container includes a plurality of container walls that define a container cavity, and an exercise structure, wherein the exercise structure includes at least one platform connector comprising a first brace plate parallel to a second brace plate, and at least one brace bar coupling the first brace plate and the second brace plate, wherein the at least one platform connector is securely associated with at least one of the plurality of container walls such that the at least one brace bar is non-perpendicular with the at least one of the plurality of container walls, and wherein when the exercise structure is securely associated with the at least one of the plurality of container walls, the exercise structure is supported by the system container.

11. The FTS of claim 10, wherein the plurality of container walls includes a container front, a container rear, a container first side, a container second side, a container bottom, and a container top.

12. The FTS of claim 11, wherein when the exercise structure is connected to the system container, the exercise structure is connected to an external surface of at least one of the container front, container rear, container first side, container second side, container bottom, or container top.

13. The FTS of claim 11, wherein when the exercise structure is connected to the system container, the exercise structure is connected to an internal surface of at least one of the container front, container rear, container first side, container second side, container bottom, or container top.

14. The FTS of claim 11, wherein the at least one brace bar is non-perpendicularly and securely associated with at least one of the container front, container rear, container first side, container second side, container bottom, and container top via at least one of a bolt, a screw or a tab/slot combination.

15. The FTS of claim 10, wherein when the exercise structure is connected to the system container, the exercise structure is positioned away from the ground surface.

16. The FTS of claim 10, wherein the exercise structure includes at least one of a pull-up bar, a dip bar, a climbing rope, a weight bench/support, a universal weight system, a bungee hook, a jumping platform, a treadmill, an elliptical or a stair climber.

17. The FTS of claim 10, wherein when the exercise structure is connected to the system container, the at least one brace bar is non-horizontal relative to the system container.

18. The FTS of claim 10, wherein the exercise structure is stowable within the container cavity.

19. The FTS of claim 10, wherein the system container includes at least one door, wherein the at least one door is configurable between an open configuration and a closed configuration, wherein when the at least one door is in the closed configuration, the at least one door is configured to cover enclose the container cavity.

20. A Stowable Functional Support Platform, comprising:

a system container, wherein the system container includes a container front, a container rear, a container first side, a container second side, a container bottom, and a container top, wherein the container front, container rear, container first side, container second side, container bottom, and container top define a container cavity, and a functional support platform, wherein the functional support platform includes a platform connector comprising a first brace plate and a second brace plate, and a plurality of brace bars coupling the first brace plate to the second brace plate, where at least one brace bar is non-perpendicular to the first brace plate, the second brace plate, or both, wherein the platform connector is securely associated with at least one of the container front, container rear, container first side, container second side, container bottom, or container top, and wherein when the functional support platform is securely associated with at least one of the container front, container rear, container first side, container second side, container bottom, or container top, the functional support platform is supported by the system container.

* * * * *